US005253752A

United States Patent [19]

Jang

[11] Patent Number: 5,253,752

[45] Date of Patent: Oct. 19, 1993

[54] SOAP DISH

[76] Inventor: Maan J. Jang, P.O. Box 82-144, Taipei, Taiwan

[21] Appl. No.: 41,865

[22] Filed: Apr. 2, 1993

[51] Int. Cl.[5] ..... A47K 5/08

[52] U.S. Cl. ..... 206/77.1; 206/818; 220/478; 220/483; 248/318; 248/309.4

[58] Field of Search ..... 206/77.1, 204, 818; 220/478, 480, 483, DIG. 6; 211/81; 248/318, 309.1, 309.4

[56] References Cited

U.S. PATENT DOCUMENTS

| | | | |
|---|---|---|---|
| 2,704,907 | 3/1955 | Durkee | 206/77.1 |
| 2,732,696 | 1/1956 | Baker | 220/DIG. 6 |
| 3,670,530 | 6/1972 | Filipak | 220/478 |
| 4,548,572 | 10/1985 | Hoffman | 206/77.1 |
| 4,993,546 | 2/1991 | Southard | 206/77.1 |
| 5,037,055 | 8/1991 | Lorenzana et al. | 248/309.1 |
| 5,181,606 | 1/1993 | Martell | 206/77.1 |

*Primary Examiner*—David T. Fidei
*Attorney, Agent, or Firm*—Alfred Lei

[57] ABSTRACT

This invention relates to a soap dish and in particular to one including an inclined platform; a seat fixedly mounted on the bottom of the inclined platform and having an iron plate thereon; a liquid container having a U-shaped member pivotally connected with the seat, the U-shaped member having thereon a magnet engageable with the iron plate of the seat; and a sponge received in the liquid container.

2 Claims, 4 Drawing Sheets

SOAP DISH

BACKGROUND OF THE INVENTION

It has been found that the prior art soap dishes on the market are simply a container for receiving a soap. However, the liquid in such soap dishes cannot be exhausted out of the soap dishes automatically and requires manual operation to drain the liquid. Hence, the soap is easily softened in such soap dishes and consumes fast.

Therefore, it is an object of the present invention to provide an improved soap dish which may obviate and mitigate the above-mentioned drawbacks.

SUMMARY OF THE INVENTION

This invention relates to an improved soap dish.

It is the primary object of the present invention to provide a soap dish which may keep the soap dried in a short time.

It is another object of the present invention to provide a soap dish having a liquid container which will be turned downward when full of water.

It is still another object of the present invention to provide a soap dish which will enable the soap to pass therethrough when it is almost reduced to a minimum size.

It is still another object of the present invention to provide a soap dish which is simple in construction.

It is a further object of the present invention to provide a soap dish which is easy to use.

Other objects and merits and a fuller understanding of the the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
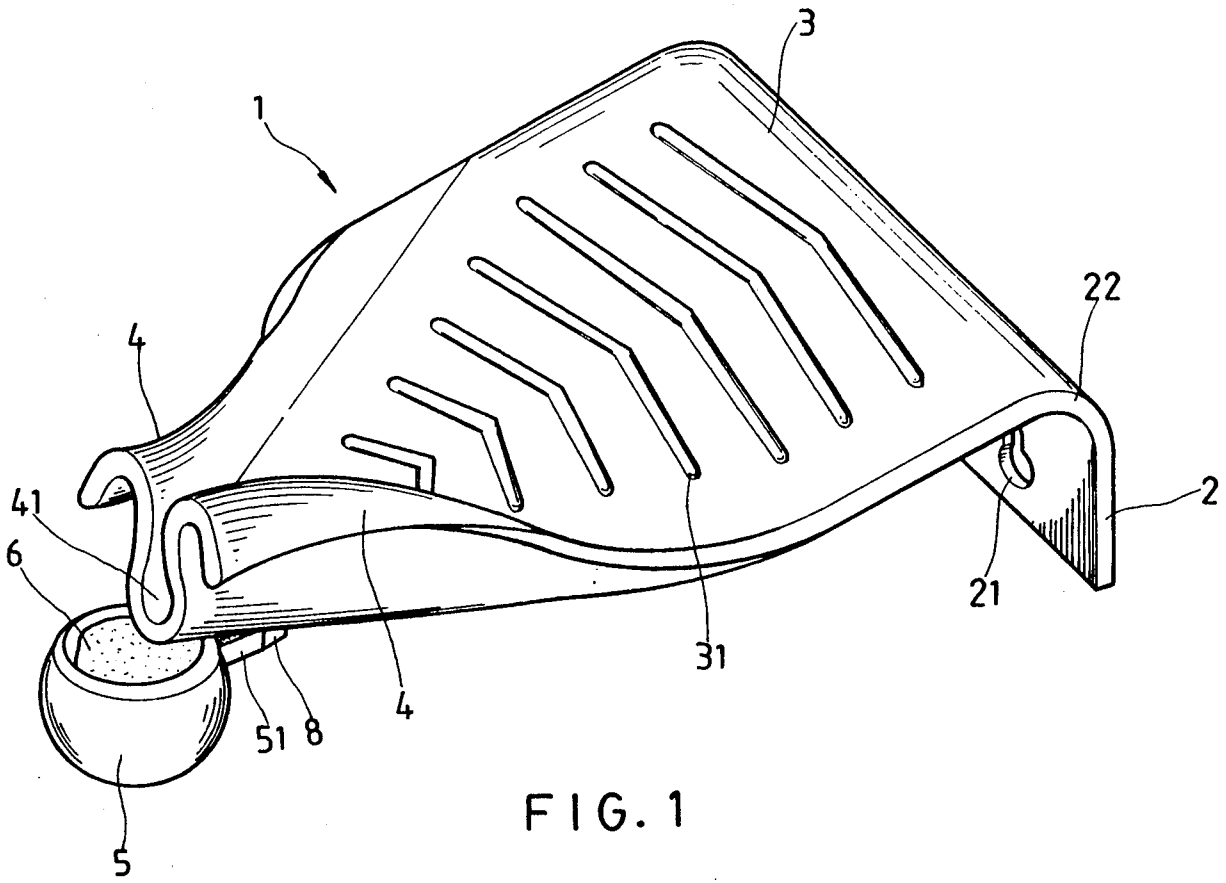
FIG. 1 is a perspective view of the present invention.

With reference to the drawings and in particular to FIG. 1 thereof, the soap dish according to the present invention comprises a vertical leg 2 on which there are two slots 21. The upper end of the vertical leg 2 is connected with a rounded angle 22 which is in turn connected with an inclined platform 3 having a plurality of V-shaped protuberances 31. Further, the inclined platform 3 is provided with two wings 4 at the end thereby forming an opening 41 between the inclined platform 3 and the two wings 4.

Figure 2:
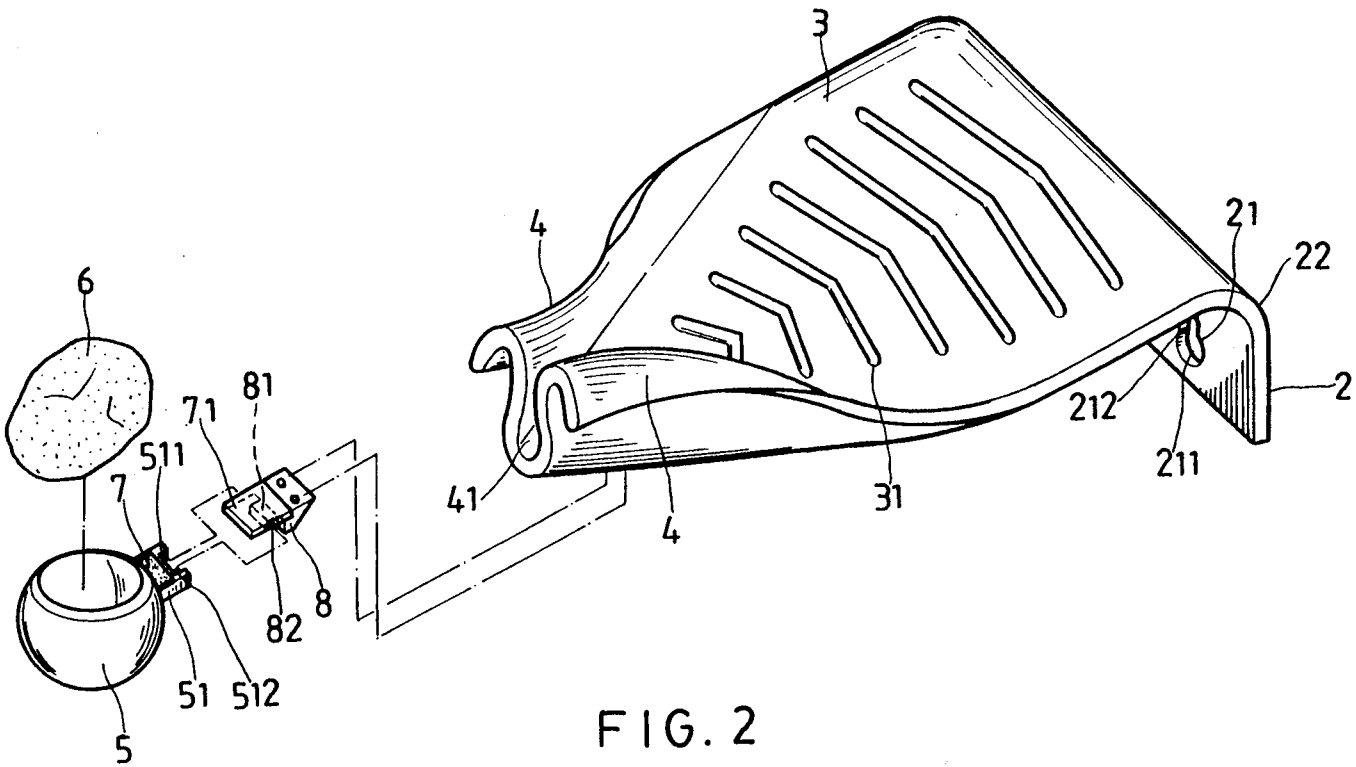
FIG. 2 is an exploded view of the present invention.
Figure 3:
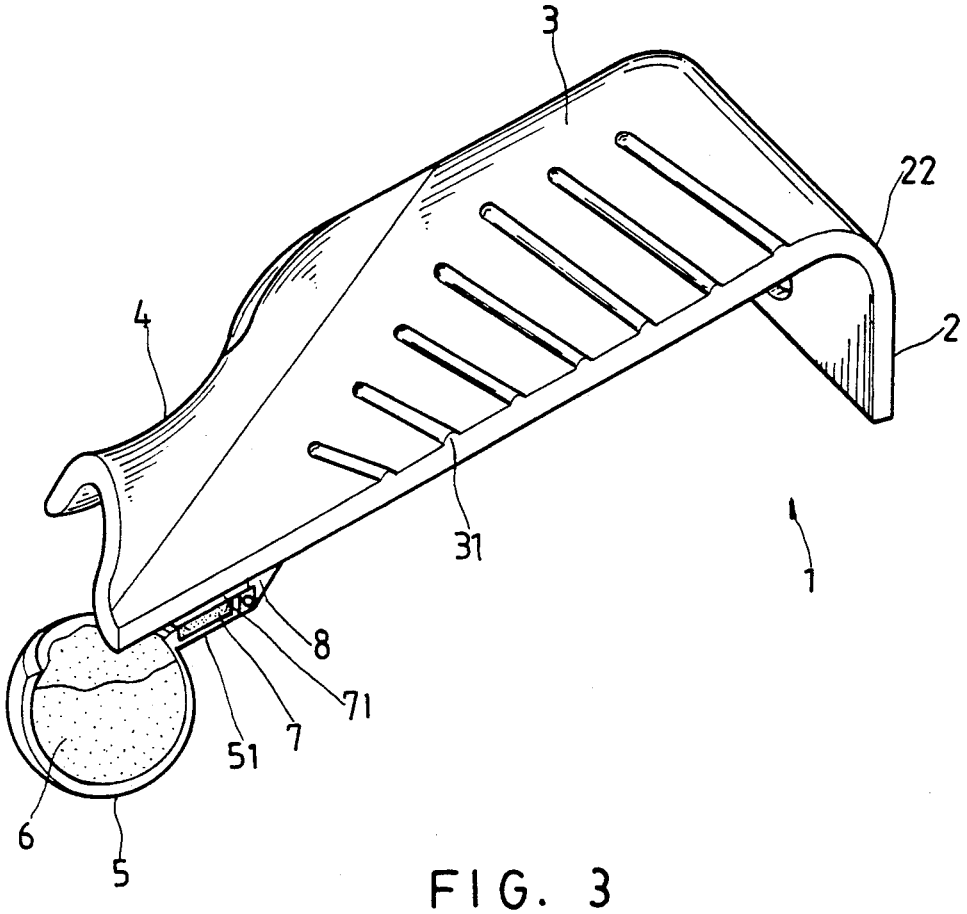
FIG. 3 is a sectional perspective view of the present invention.

As shown in FIG. 2, a liquid container 5 is mounted under the opening 41 and contains a sponge 6 (see FIG. 3). The rear side of the liquid container 5 is provided with a U-shaped member 51 on which there is a magnet 7. In addition, the U-shaped member 51 has two legs 511 each provided with a pin 512. A seat 8 is fixedly mounted on the bottom of the inclined platform 3 and has a projection 81 with two holes 82 adapted to receive the pins of the U-shaped member 51. An iron plate 71 is rigidly mounted on the seat 8 and just located on the magnet 7 of the U-shaped member 51. Hence, the liquid container 5 may be turned downward with respect to the pins 512.

The liquid container 5 is kept in a horizontal position when the liquid container 5 is turned upward so that the magnet 7 attracts the iron plate 71 of the seat 8. When the sponge 5 in the liquid container 5 is full of water, the gravitational force of the liquid container will be greater than the attracting force between the magnet 7 of the liquid container 5 and the iron plate 71 of the seat 8 so that the liquid container 5 will be turned downward thereby arousing the user to replace the sponge 6.

Referring to FIG. 3, the protuberances 31 of the inclined platform 3 are used to decrease the contact area between the soap 10 and the inclined platform 3 and therefore keeping the soap dried. The soap 10 is disposed vertically on the inclined platform 3 with its front end in contact between the two wings 4 (see FIG. 4). Hence, in case the soap 10 may pass through the opening 41, it is necessary to replace the soap 10 with a new one.

Figure 4:
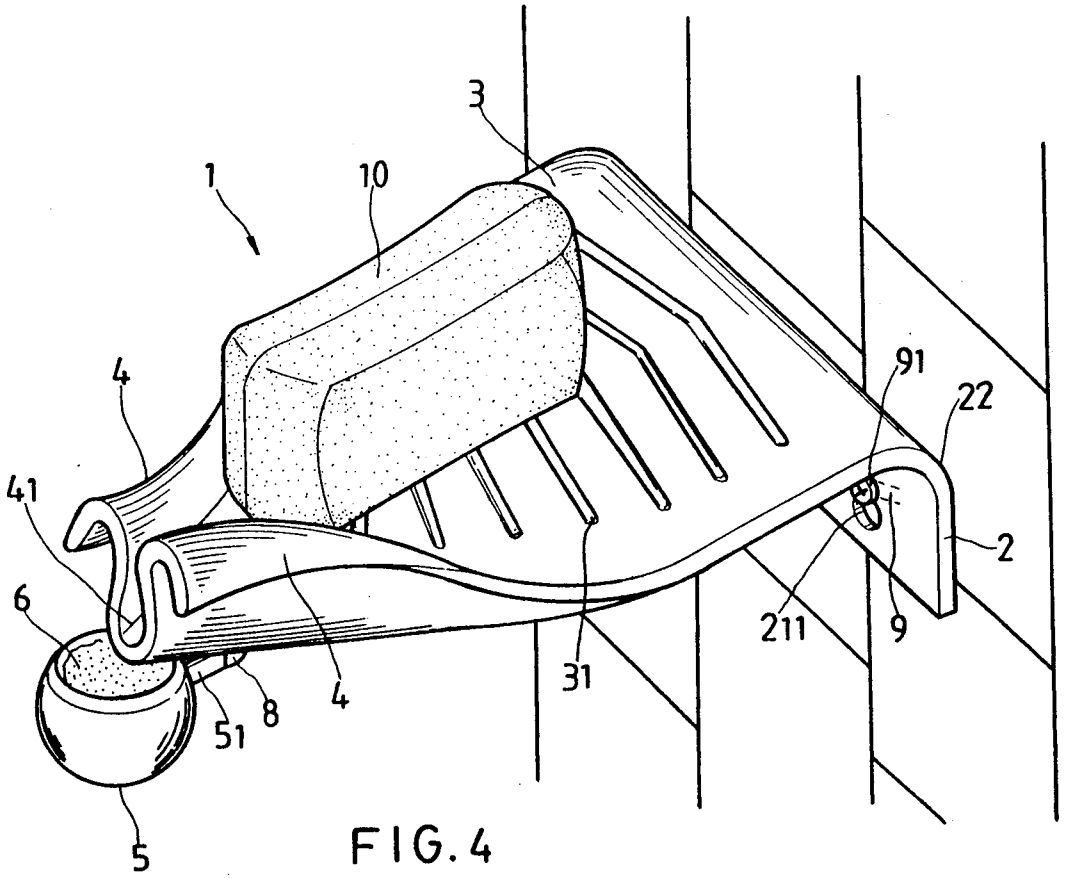
FIG. 4 is a working view of the present invention.

Looking now at FIG. 4, the soap dish according to the present invention may be hanged on a wall by putting the large portions 211 of the slots 21 on two nails 9 and engaging the small portions 212 of the slots with the heads 91 of the nails 9. Then, the inclined platform 3 makes an obtuse angle with the wall thus enabling the liquid to flow down into the liquid container 5 and therefore drying the soap 10.

Although the present invention has been described with a certain degree of particularity, it is understood that the present invention disclosure is made by way of example only and that numerous changes in the detail of construction and the combination and arrangement of parts may be resorted to without departing from the spirit and scope of the invention as hereinafter claimed.

I claim:

1. A soap dish comprising:

an inclined platform;

a seat fixedly mounted on the bottom of said inclined platform and having an iron plate thereon;

a liquid container having a U-shaped member pivotally connected with said seat, said U-shaped member having thereon a magnet engageable with the iron plate of said seat; and a sponge received in said liquid container.

2. The soap dish as claimed in claim 1, wherein said inclined platform has a plurality of protuberances thereon, a downwardly depending leg at one end, and two upwardly depending wings at another end thereby forming an opening therebetween.

* * * * *